US005918388A

United States Patent [19]

Emerson et al.

[11] Patent Number: 5,918,388

[45] Date of Patent: Jul. 6, 1999

[54] HEEL CLEAT FOR A SNOWSHOE

[75] Inventors: Daniel T. Emerson, Palo Alto; Charles Bently Warner, San Francisco, both of Calif.

[73] Assignee: Atlas SnowShoe Co., San Francisco, Calif.

[21] Appl. No.: 09/009,838

[22] Filed: Jan. 21, 1998

Related U.S. Application Data

[63] Continuation-in-part of application No. 08/999,888, Dec. 22, 1997, which is a continuation of application No. 08/514,781, Aug. 14, 1995, Pat. No. 5,699,630, which is a continuation of application No. 08/091,973, Jul. 15, 1993, Pat. No. 5,440,827, which is a continuation of application No. 07/748,425, Aug. 22, 1991, Pat. No. 5,253,437.

[51] Int. Cl.[6] ..... A43B 5/04; A43C 15/00

[52] U.S. Cl. ..... 36/124; 36/62

[58] Field of Search ..... 36/62, 7.7, 7.6, 36/122, 123, 124, 125

[56] References Cited

U.S. PATENT DOCUMENTS

| | | | |
|---|---|---|---|
| 2,317,647 | 4/1943 | Simunds | 36/62 |
| 2,358,066 | 9/1944 | Harvey | 36/62 X |
| 2,401,891 | 6/1946 | Smith | 36/62 |
| 5,253,437 | 10/1993 | Klebahn et al. | 36/122 |
| 5,440,827 | 8/1995 | Klebahn et al. | 36/122 |
| 5,687,491 | 11/1997 | Klebahn | 36/122 X |
| 5,699,630 | 12/1997 | Klebahn et al. | 36/124 |

FOREIGN PATENT DOCUMENTS

| | | | |
|---|---|---|---|
| 1189492 | 10/1959 | France | 36/62 |

*Primary Examiner*—B. Dayoan
*Attorney, Agent, or Firm*—Thomas M. Freiburger

[57] ABSTRACT

A snowshoe has a metal heel cleat of one-piece construction, providing the dual functions of angularly disposed teeth which extend down from the snowshoe's deck to engage snowy or icy terrain, and rows of serrations extending upwardly through a membrane, to a position for contact with the bottom of the user's boot heel for high friction, gripping engagement when weight is placed on the heel. The heel cleat device has a base platform which is positioned between two deck membrane layers, a lower of which is penetrated by the terrain-engaging cleat teeth and the upper of which is penetrated by the smaller, upwardly facing serrations which engage with the boot heel.

5 Claims, 3 Drawing Sheets

HEEL CLEAT FOR A SNOWSHOE

This application is a continuation-in-part of application Ser. No. 08/999,888, filed Dec. 22, 1997, which was a continuation of Ser. No. 08/514,781, filed Aug. 14, 1995, now U.S. Pat. No. 5,699,630, which was a continuation of Ser. No. 08/091,973, filed Jul. 15, 1993, now U.S. Pat. No. 5,440,827, which was a continuation of Ser. No. 08/748,425, filed Aug. 22, 1991, now U.S. Pat. No. 5,253,437.

BACKGROUND OF THE INVENTION

The invention relates to snowshoes, and in particular is concerned with an efficient heel cleat design for a snowshoe.

U.S. Pat. Nos. 5,440,827 and 5,699,630 shows a snowshoe with a front claw and a heel cleat. The heel cleat is secured to the deck membrane of the snowshoe and is positioned to be engaged by the heel of the user's shoe or boot, with downwardly extending teeth to grip terrain when the heel bears down on the snowshoe.

The snowshoe heel cleat disclosed in the above referenced patents, both of which are incorporated herein by reference, had a horizontal terrain facing member, or base platform, from which a pair of side wall flanges with teeth extended downwardly, through slits in the snowshoe deck's membrane. Thus, the horizontal plate or base platform of the referenced patents was above a deck membrane layer, allowing the downwardly extending teeth to engage terrain, but isolating the base platform or plate from contact with ice and snow to avoid buildup of ice at the bottom of the snowshoe deck. Atlas Snowshoe Company follows the snowshoe heel cleat design described in the above referenced patents, but in later snowshoes has included an additional plate on the top of the snowshoe deck and riveted together with the horizontal platform or plate of the heel cleat. The additional plate has been positioned to bear against and additional, upper layer of deck membrane, with the cleat's horizontal plate or platform being sandwiched between the two membrane layers. The purpose of the upper plate has been to provide rows of small serrations extending upwardly for engaging with the bottom of the user's boot, for high friction gripping by the boot as the snowshoe is used. Typically, these rows of serrations were four in number, one at each of the front edge, back edge and two side edges of the upper plate.

It is an object of the invention to integrate the upper plate and the lower cleat component of the described rear cleat assembly into a single metal component which has the terrain engaging teeth and the smaller serrations for engagement by the user's boot, thereby making the heel cleat assembly more economically efficient in components as well as assembly.

SUMMARY OF THE INVENTION

A heel cleat device according to the invention is designed for assembly between two layers of deck membrane in a snowshoe. The heel cleat has a generally flat base plate or platform which is to be sandwiched between the two deck layers. Left and right flanges depend from the base platform, each being serrated to define a row of teeth for engaging against terrain when in use in a snowshoe. In addition, at least one row of small serrations extend upwardly from the base platform, to a sufficient extent to pass through the upper membrane in the deck of the snowshoe, in position to be engaged by the heel of a user's boot when weight is placed on the heel to bear against the heel cleat. The base platform, left and right flanges and row of small serrations preferably all are integrally formed as a single piece.

In one preferred embodiment, the heel cleat device is formed as a metal stamping, the left and right teeth flanges bending downward from the base platform and the row of small serrations bending upwardly from the base platform. Holes may be provided in the base plate or platform to receive rivets or other fasteners for retaining the heel cleat device firmly in place in the snowshoe deck. The metal heel cleat is advantageously formed of stainless steel, but could be injection molded of a high-strength abrasion-resistant polymer, such as glass-filled nylon.

Preferably two such rows of small serrations extend upwardly from the base platform, forming a front and rear line of serrations to be engaged by the user's boot. The heel cleat device may be generally trapezoidal in shape, with the small serrations extending laterally at front and rear and the flanges with teeth converging toward one another from front to back of the heel cleat.

It is thus among the objects of the invention to outfit a snowshoe with an efficiently formed and assembled heel cleat device which replaces two components of a prior configuration. These and other objects, advantages and features of the invention will be apparent from the following description of a preferred embodiment, considered with the accompanying drawings.

DESCRIPTION OF PREFERRED EMBODIMENTS

Figure 1:
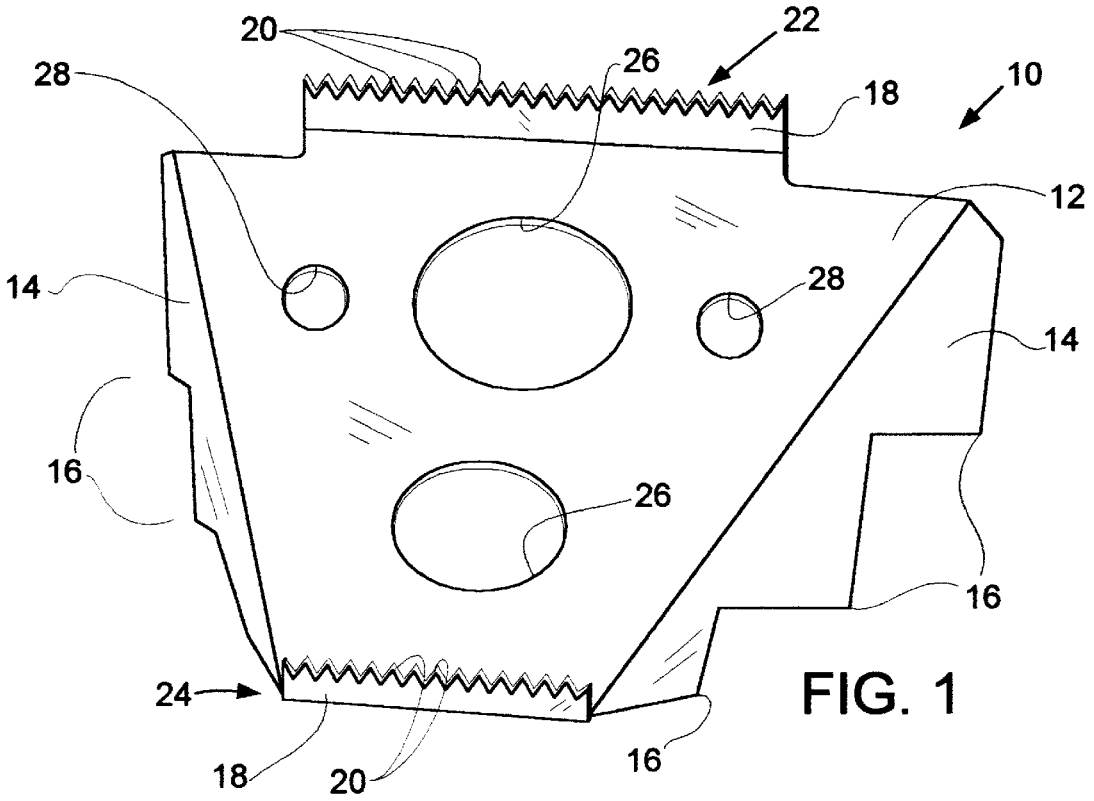
FIG. 1 shows a heel cleat device according to the invention, in perspective view from an upper side.

In the drawings, FIGS. 1–4 show a heel cleat device 10 having a base plate or platform 12, left and right rows of flanges 14 with rows engaging teeth 16, and rows 18 of small serrations or teeth 20 extending up from fore and aft ends of the base platform 12.

Figure 2:
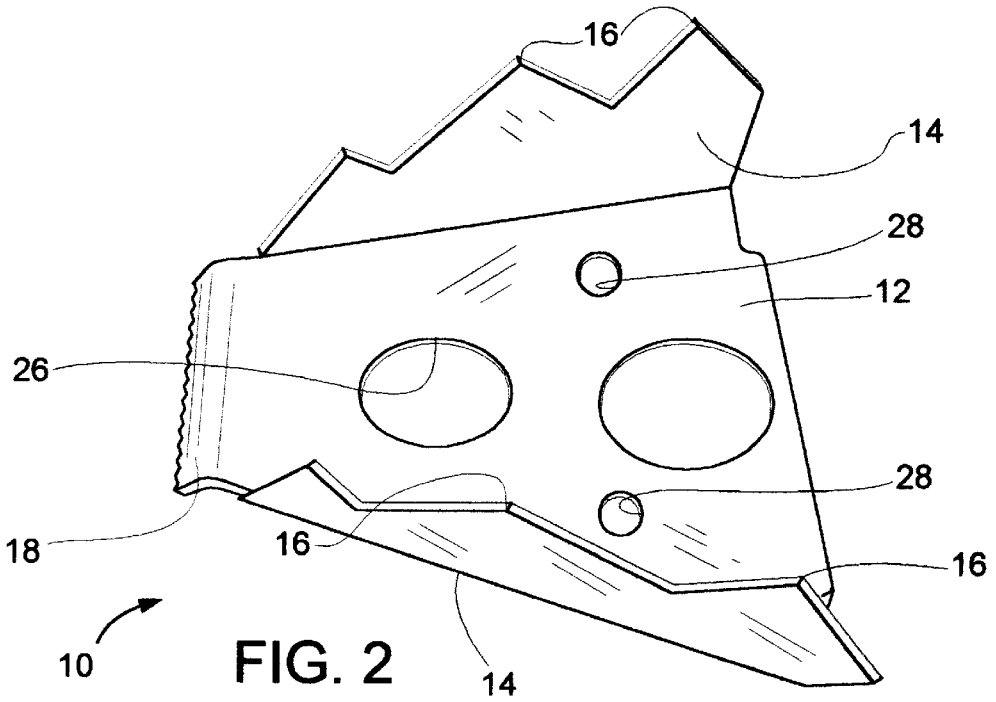
FIG. 2 shows the heel cleat device in perspective from its lower side.

In a preferred embodiment, as shown in FIG. 2, the heel cleat device 10 comprises an integral metal piece, which may comprise a stamping of stainless steel. By locating the rows of terrain-engaging teeth 16 at left and right, and the rows 18 of small serrations 20 at front and rear of the heel cleat 10, all of these appendages can be formed by bending from a single flat metal piece.

As also shown in FIGS. 1 and 2, the left and right flanges 14 which carry the teeth 16 preferably converge toward one another from front 22 to rear 24 of the device. This is similar to the configuration shown in U.S. Pat. No. 5,440,827, as is the varying size of the teeth 16, from larger to smaller in the direction of front to back.

In addition, the flanges 14 carrying the teeth 16 may flare outwardly to some extent as they depend downwardly, which is illustrated in FIGS. 1 and 2. This also follows the teaching of U.S. Pat. No. 5,440,827 and related patents.

The base platform 12 may have two large openings 26 to conserve material and weight; two additional holes 28, preferably located left and right as shown, are smaller than the openings 26 and are positioned for securing to a snowshoe deck by rivets or other fasteners.

Figure 4:
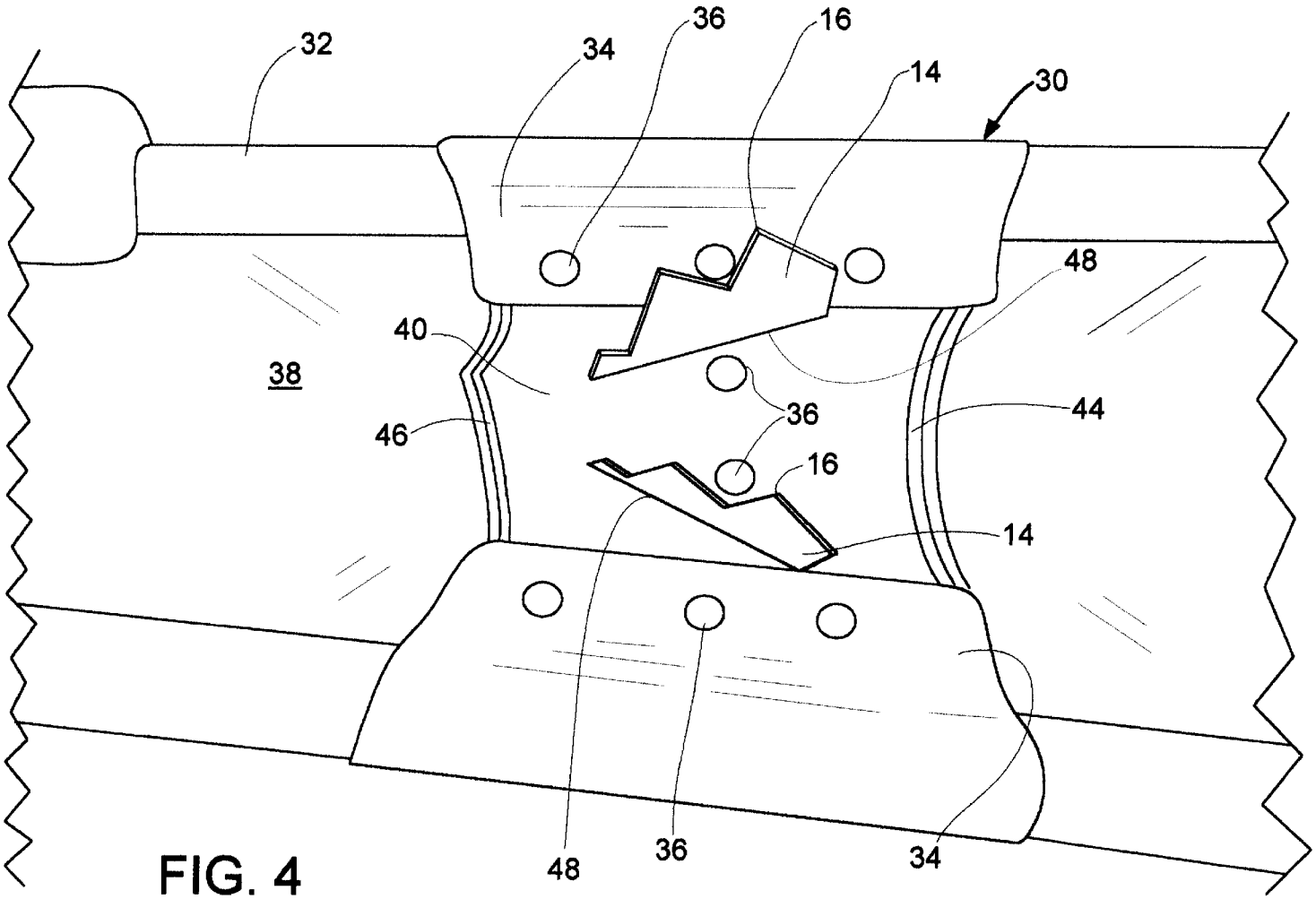
FIG. 4 is a perspective view showing a portion of the snowshoe from the bottom side, showing the heel cleat device extending through the deck at the bottom side.

FIGS. 4 and 5 show the heel cleat device 10 as assembled in a snowshoe deck, the deck being generally indicated by the reference number 30. As illustrated, the deck 30 is suspended on a snowshoe frame 32, which may be formed of aluminum tubing. The deck may be secured to the frame 32 by wrapping over the frame as shown at 34, and then securing the decking material to itself by rivets 36 or other reliably secure connection.

Figure 3:
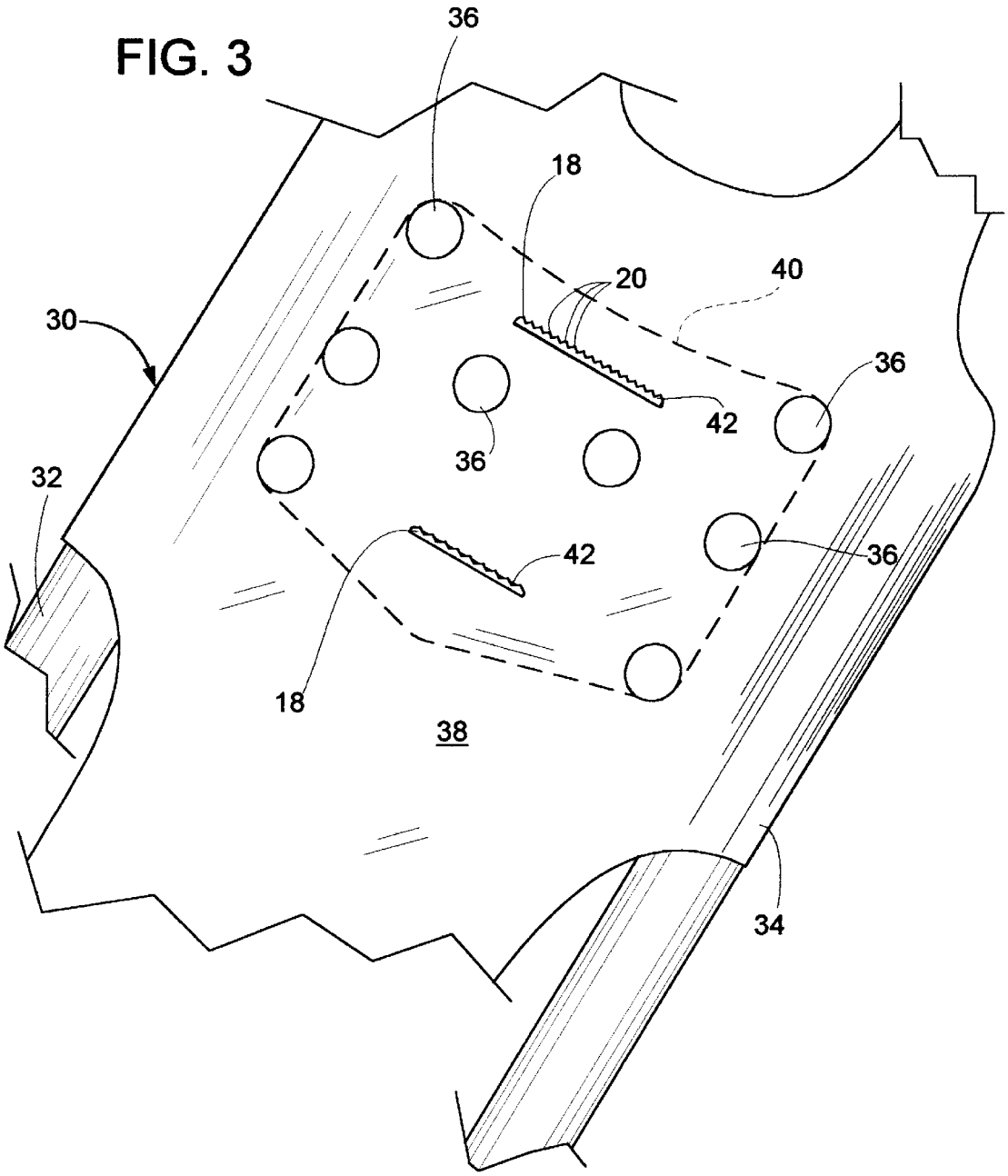
FIG. 3 is a perspective view showing a portion of a snowshoe, revealing part of the deck of the snowshoe where the heel cleat device is assembled.

FIG. 3 shows the snowshoe deck from the top, with the tail end of the snowshoe toward the bottom of the drawing figure; in FIG. 4 the tail end of the snowshoe is to the left. Both these figures reveal that the snowshoe deck includes two layers in the region of the assembly of the heel cleat 10, both being flexible, membrane-type layers. An upper layer 38 of the decking is shown in FIG. 3 with a lower layer 40 indicated below. As shown, the rows 18 of small serrations 20 extend up through a slits 42 in the upper decking layer. Rivets 36 retain the heel cleat device in position between the decking layers 38 and 40, and additional rivets 36, as noted above, secure the upper decking layer to itself to retain it on the frame, and also serve to help retain the lower decking layer 40 in position. The lower decking layer may additionally be bonded to the upper decking by heat bonding (e.g. RF Welding), along adjoining lines 44 and 46 seen in FIG. 4.

It should be understood that the upper and lower decking layers 30 and 40 could be reversed; that is, the smaller patch of decking membrane could be at the top side of the snowshoe deck 30 rather than at the bottom. The important consideration is that the two layers of decking cooperate with the configuration of the heel cleat device 10 shown in FIGS. 1 and 2, to produce an assembly in which the base plate or platform 12 is isolated from ice and snow, and in which only the small serrations of teeth 20 extend up to the top of the snowshoe deck for contact with the user's shoe or boot heel.

The assembly shown in FIG. 3 can also include a high-friction rubbery patch (not shown) on top of the decking layer 38, between the two upwardly extending rows 18 and secured together to the membranes also by the two rivets 36. Such a rubbery patch can provide additional friction and some insulation of the top of the snowshoe, in the boot heel area, from ice buildup.

FIG. 4 shows the assembly of FIG. 3 from the bottom side, revealing the left and right flanges 14 with teeth 16 protruding through slits 40 through slits 48 in the lower deck membrane layer 40.

Although the heel cleat is illustrated as sandwiched between two deck membranes, it should be understood that the cleat could be mounted against a single deck membrane. The cleat can be mounted with its base platform lying against the top surface of the single membrane, with the teeth engaging down through slits in the membrane, or it can be mounted against the bottom of a single membrane, with the small upwardly-facing serrations extending up through slits.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A snowshoe having a snowshoe deck of flexible membrane material, and including a heel cleat assembled in the deck of the snowshoe at a position where a user's boot will bear against the deck, the snowshoe deck including upper and lower deck layers, comprising:

a generally flat base platform assembled between the upper and lower deck layers of the snowshoe, left and right flanges extending downward from the base platform and each being serrated to define a row of teeth for engaging against terrain when the snowshoe is in use, the lower deck layer of the snowshoe having a pair of slits through which the left and right flanges and terrain-engaging teeth pass downwardly, the upper deck layer of the snowshoe having a slit, and the heel cleat having at least one row of small serrations extending upwardly from the base platform and passing through the slit in the upper deck layer in position to be engaged by the heel of a user's boot when weight is placed on the heel to bear against the heel cleat, means securing the heel cleat to the snowshoe deck layers, and the base platform, left and right flanges with teeth and upper row of serrations being integrally formed as one piece.

2. A snowshoe according to claim 1, wherein the means securing the heel cleat comprises rivets passing through both deck layers and through holes in the base platform of the heel cleat.

3. A snowshoe according to claim 1, wherein the heel cleat includes two said upwardly extending rows of small serrations, the two rows being generally parallel and at forward and aft positions on the heel cleat, each passing through a said slit in the upper deck layer.

4. A heel cleat for a snowshoe, for assembly in the deck of the snowshoe at a position where a user's boot will bear against the deck, comprising:

a generally flat base platform for assembly against a deck membrane in the snowshoe, left and right flanges extending downward from the base platform and each being serrated to define a row of teeth for engaging against terrain when in use in a snowshoe, two rows of small serrations extending upwardly from the base platform to a sufficient extent to pass through an opening in an upper membrane in the deck of a snowshoe in position to be engaged by the heel of a user's boot when weight is placed on the heel to bear against the heel cleat, each row being generally linear and the two rows being spaced apart and parallel to one another, and the base platform, left and right flanges with teeth, and upper rows of serrations being integrally formed as one piece.

5. A snowshoe having a snowshoe deck of flexible membrane material, and including a heel cleat assembled in the snowshoe deck at a position where a user's boot will bear against the deck, comprising:

the heel cleat having a generally flat base platform assembled against the bottom of the snowshoe deck, the heel cleat including left and right flanges extending downward from the base platform and each being serrated to define a row of teeth for engaging against terrain when the snowshoe is in use, the snowshoe deck having a slit, and the heel cleat having at least one row of small serrations extending upwardly from the base platform and passing through the slit in the snowshoe deck in position to be engaged by the heel of a user's boot when weight is placed on the heel to bear against the heel cleat, means securing the heel cleat to the snowshoe deck, and the base platform, left and right flanges with teeth, and upper row of serrations being integrally formed as one piece.

* * * * *